US009476551B2

(12) United States Patent
Thijssen et al.

(10) Patent No.: US 9,476,551 B2
(45) Date of Patent: Oct. 25, 2016

(54) LIGHT-EMITTING CONSTRUCTION ELEMENT

(71) Applicant: KONINKLIJKE PHILIPS N.V., Eindhoven (NL)

(72) Inventors: Johannes Maria Thijssen, Best (NL); Andreas Aloysius Henricus Duijmelink, Helmond (NL); Bram Knaapen, Eindhoven (NL); Anthonie Hendrik Bergman, Nuenen (NL); Jonathan David Mason, Waalre (NL); Elena Tiziana Ferrari, Nuenen (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 98 days.

(21) Appl. No.: 14/370,359

(22) PCT Filed: Dec. 28, 2012

(86) PCT No.: PCT/IB2012/057789

§ 371 (c)(1),
(2) Date: Jul. 2, 2014

(87) PCT Pub. No.: WO2013/102835

PCT Pub. Date: Jul. 11, 2013

(65) Prior Publication Data

US 2014/0340897 A1 Nov. 20, 2014

Related U.S. Application Data

(60) Provisional application No. 61/582,512, filed on Jan. 3, 2012.

(51) Int. Cl.

| | |
|---|---|
| ***E01F 9/00*** | (2006.01) |
| ***F21S 8/00*** | (2006.01) |
| ***F21S 8/02*** | (2006.01) |
| ***F21V 33/00*** | (2006.01) |
| ***E04F 15/08*** | (2006.01) |

(Continued)

(52) U.S. Cl.

CPC ..... *F21S 8/00* (2013.01); *E04F 15/082* (2013.01); *F21S 8/022* (2013.01); *F21V 7/0091* (2013.01);

(Continued)

(58) Field of Classification Search

CPC ..... E04F 15/082; F21S 8/00; F21S 8/022; F21V 11/00; F21V 23/006; F21V 7/0091; F21Y 2101/02; B64F 1/205; E01F 9/065

See application file for complete search history.

(56) References Cited

U.S. PATENT DOCUMENTS 4,737,764 A * 4/1988 Harrison ..... E01F 9/065 340/286.13
4,794,373 A * 12/1988 Harrison ..... B60Q 3/0256 307/10.8

(Continued)

FOREIGN PATENT DOCUMENTS

DE 202005000714 U1 5/2005
EP 0658655 A1 6/1995

(Continued)

*Primary Examiner* — Peggy Neils

(57) ABSTRACT

A non-transparent light-emitting construction element (100; 200; 300; 400), comprising: a construction element having a mounting side and a user-facing side (104; 204; 304) to be facing a user when the light-emitting construction element is used in a construction; and a light-emitter (108; 404) embedded in the construction element, wherein the light-emitter is embedded in the construction element in such a way that the light-emitter is non-visible in its off-state and light from the light-emitter escapes from the construction element when the light-emitter is in its on-state.

10 Claims, 2 Drawing Sheets

(51) Int. Cl.
*F21V 7/00* (2006.01)
*F21V 11/00* (2015.01)
*F21Y 101/02* (2006.01)

(52) U.S. Cl.
CPC ..... *F21V 11/00* (2013.01); *F21V 33/006* (2013.01); *F21Y 2101/02* (2013.01); *Y10T 29/49826* (2015.01)

(56) References Cited

U.S. PATENT DOCUMENTS 7,186,012 B2 3/2007 Schevardo et al.
7,717,585 B2 * 5/2010 Bole ..... F21V 19/0005 362/249.02
2007/0103902 A1 5/2007 Hsiao
2007/0159814 A1 7/2007 Jacobsson
2009/0021939 A1 * 1/2009 Costello ..... D03D 9/00 362/249.02
2010/0254141 A1 * 10/2010 Van Herpen ..... D05C 17/02 362/249.14
2010/0272510 A1 10/2010 Mohajer

FOREIGN PATENT DOCUMENTS

EP 1469141 A1 10/2004
EP 2031296 A1 3/2009
EP 2287932 A2 2/2011
WO 2005025890 A2 3/2005
WO 2009069076 A2 6/2009

* cited by examiner

LIGHT-EMITTING CONSTRUCTION ELEMENT

CROSS-REFERENCE TO PRIOR APPLICATIONS

This application is the U.S. National Phase application under 35 U.S.C. §371 of International Application No. PCT/IB2012/057789, filed on Dec. 28, 2012, which claims the benefit of [e.g., U.S. Provisional Patent Application No. or European Patent Application No.] 61/582,512, filed on Jan. 3, 2012. These applications are hereby incorporated by reference herein.

FIELD OF THE INVENTION

The present invention relates to a light-emitting construction element and to a method of manufacturing such a light-emitting construction element.

BACKGROUND OF THE INVENTION

In many lighting applications, it is desirable to hide or to otherwise arrange the light-source so that it is not visible to an observer. In particular, where interior or exterior design aspects are important, it may be desirable that the lighting arrangement has a low visible profile when the light-source is in an off-state. One way to achieve this may be to integrate the light-source for example in ceiling tiles, floor-boards, walls or ceramic tiles. In applications where the light-source is integrated, light emitted from the light-source is commonly emitted either directly from the light-source or via an optical element such as a diffuser or a lens.

Alternatively, the light-source is optically connected to a light-guide made from transparent material such as silicone or epoxy which couples the light from the light-source to the surface of the construction element from which it is emitted.

However, in all the aforementioned applications, either the light-source or the light-guide coupled to the light-source is visible to the observer also when the light-source is turned off. Thus, there is a visual difference between the illuminating and non-illuminating areas of the construction element when the light-source is in an off-state. Accordingly, there is a need for a lighting arrangement having an integrated light-emitter which is non-visible in an off state.

SUMMARY OF THE INVENTION

According to a first aspect of the present invention, it is provided a non-transparent light-emitting construction element, comprising: a construction element having a mounting side and a user-facing side to be facing a user when the light-emitting construction element is used in a construction; and a light-emitter embedded in the construction element, wherein the light-emitter is embedded in the construction element in such a way that the light-emitter is non-visible in its off-state and light from the light-emitter escapes from the construction element when the light-emitter is in its on-state.

The present invention is based on the realization that a non-transparent light emitting construction element comprising a light-emitter which is non-visible in an off state may be achieved by embedding the light-emitter in the construction element.

A light-emitter should in the present context be understood as an element which emits light. The light-emitter may be an active element such as a light emitting diode, a solid state laser or an incandescent light-source, or it may be passive element such as the light-output region of a light-guide.

According to one embodiment of the invention, a top portion of the light-emitting construction element across substantially an entire surface area of the light-emitting construction element, on the user-facing side thereof, may be formed by a substantially uniform construction element material. By embedding a light-emitter such as for example a light emitting diode in a construction element having a substantially uniform surface area, the visual appearance of the user-facing surface area is such that the light-emitter is non-visible when in an off-state. A substantially uniform construction element material should be interpreted as a material having a substantially homogeneous surface such as for example the surface of a ceramic tile or a concrete slab.

In one embodiment of the invention, the top portion may cover the light-emitter with a segment of the construction element material being configured to make the light-emitter non-visible in an off-state and to allow passage of at least a portion of the light emitted by the light-emitter in an on-state. By covering the light-emitter with the top portion, while the light-emitter is sufficiently close to the surface, a material which in bulk form is non-transparent may allow light to be transmitted through the material provided that the layer covering the light-emitter is sufficiently thin. As the optical properties of the material in bulk form are essentially irrelevant, a large range of materials which have previously not been considered becomes possible to use in the formation of a light emitting construction element.

Furthermore, the construction element material may be selected form the group comprising stone, ceramics, concrete, porphyry and marble.

In one embodiment of the invention, the construction element may comprise a top layer having a user facing side and a mounting side, wherein the mounting side comprises a plurality of cavities and a carrier comprising a plurality of light-emitters, each being arranged in a respective one of the cavities in the top layer. The mounting side of the top layer is the side opposite the user facing side. One way to embed light-emitters in the construction element material is to form cavities in a mounting side of the construction element such that the user facing side remains a uniform and homogeneous surface.

Moreover, the top layer at the positions of the cavities may have a thickness such that light emitted by light-emitters arranged in the cavities is transmitted through the top layer and emitted from the user facing side of the top layer. Thus, the cavities in the mounting side should reach sufficiently far into the construction element so that the remaining thickness between the cavity and the user facing-surface is such that light from the light-emitter may be transmitted through the top layer at the positions of the cavities when the light-emitter is in an on state.

In one embodiment of the invention, the top layer at the positions of the cavities may have a light-transmittance of least 20%. As the light emitted by the light-emitters should be able to be transmitted through the top layer where the cavities are arranged, the transmittance must not be too low. Accordingly, it has been found that a light-transmittance of at least 20% is preferable.

Furthermore, a thickness of the top layer at the positions of the cavities may preferably be in the range of 0.5 mm to 2 mm. For the aforementioned materials, a thickness of the segment of the top layer at the positions of the cavities in the range of 0.5 mm to 2 mm provides sufficient transmission of light in an on-state of the light-emitter while at the same time being sufficiently thick so that the light-emitter is non-visible in an off-state.

According to one embodiment of the invention, the top layer at the positions of said cavities may have openings smaller than the size of the cavity such that light emitted by light-emitters arranged in said cavities is transmitted through the openings and emitted from the user facing side of the top layer. Provided that the size of the openings of in the top layer is sufficiently small, the visual appearance of the user-facing surface of the top layer remains the same as if no openings where present. However, as light emitted by the light-emitter may be transmitted through the openings, an improved illumination effect in the on-state of the light-emitter may be achieved while the light-emitter remains non-visible in an off-state.

In one embodiment of the invention, the size of the openings may be in the range of 0.5 mm to 2 mm. In the case of circular openings, the size may refer to the diameter of the opening and in the case of openings having a non-circular cross-section the size may refer to the largest dimension of such a cross-section. Elongate openings in the form of slits having a width within the above range may be also be used.

In one embodiment of the invention, the top layer may have a rough surface having peaks and valleys and the cavities in the top layer may be extending through the top layer.

Furthermore, light-emitters arranged in the cavities in said top layer may be protruding from the surface of the top layer on the user facing side. By having a light-emitter which is slightly protruding from a rough surface, the relatively small portion of the light-emitter protruding from the surface is not recognized as a light-emitter, instead, it is seen as a portion of the surface. The visual appearance of the peaks of the rough surface may be further made to blend in with the surface by ensuring that the color of the light-emitter protruding from the surface has the same color as the surface itself. Preferably, the peaks of the rough surface extend above the protruding light-emitter so that the light-emitter can be considered to be substantially located in the valleys of the surface.

In one embodiment of the invention, the light-emitter may advantageously be the light-output region of a light-guide. By embedding a light-guide in the construction element, the use of a specific light-emitter carrier layer may be avoided. An advantage related to this embodiment is that a light-source such as a solid-state light-source may be arranged outside of the construction element, optically connected to the light-guide. Thereby, it is possible to achieve a plurality of areas where light is emitted from a construction element through the use of a single light-source. A further advantage is that such light-sources arranged outside of the construction element may be more easily replaced. Furthermore, solid state light-sources of higher intensity may be used compared to when such light-sources are embedded as the cooling arrangement of the light-source may be arranged outside of the construction element. Moreover, the light-guide may advantageously be enclosed by a reflector in order to reduce the loss of light in the construction element. This may for example be achieved by covering the light-guide with a reflective coating or by forming the required reflector, inserting it into the top layer and filling it, for example by casting, with a transparent resin acting as light-guide.

According to a second aspect of the present invention, it is provided a method for manufacturing a non-transparent light-emitting construction element comprising the steps of: providing a carrier having at least one light-emitter arranged thereon; providing a layer of construction element material arranged on said carrier such that said at least one light-emitter is embedded in said construction element material in such a way that said light-emitter is non-visible in its off-state and light from the light-emitter escapes from the construction element when the light-emitter is in its on-state.

According to one embodiment of the invention, the method for manufacturing a non-transparent light-emitting construction element may further comprise the step of arranging the carrier and top layer on a support layer. The support layer may advantageously act as mechanical support for the top layer and the light-source carrier.

Effects and features of this second aspect of the present invention are largely analogous to those described above in connection with the first aspect of the invention.

BRIEF DESCRIPTION OF THE DRAWINGS

This and other aspects of the present invention will now be described in more detail, with reference to the appended drawings showing embodiments of the invention, wherein.

DETAILED DESCRIPTION

In the present detailed description, various embodiments of a non-transparent light-emitting construction element according to the present invention are mainly discussed with reference to a construction element made from a stone material having light-emitters embedded therein.

It should be noted that this by no means limits the scope of the present invention which is equally applicable to construction elements based on for example concrete or ceramic materials.

Figure 1:
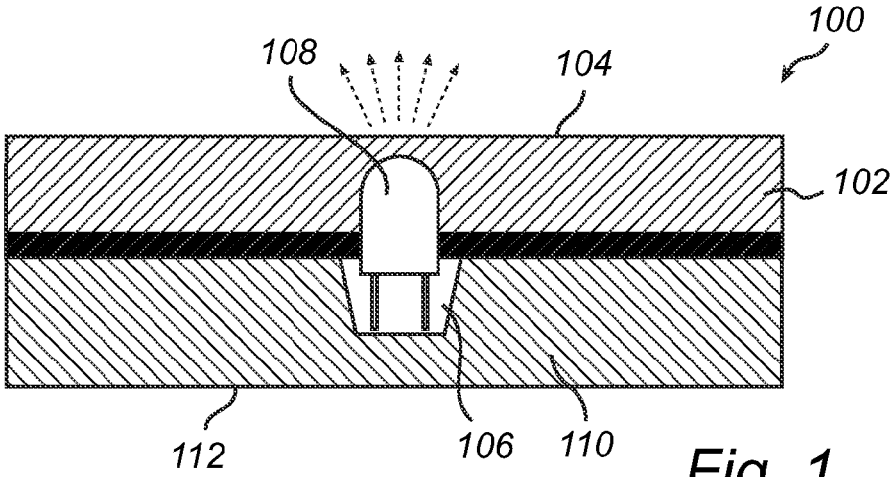
FIG. 1 schematically illustrates a construction element according to a first embodiment of the invention.

FIG. 1 schematically illustrates a light-emitting construction element 100 according to an embodiment of the invention comprising a top layer portion 102 in the form of a sheet having a top surface 104 which is the user facing side of the construction element, a carrier 106 comprising at least one light-emitter 108 and a support layer 110. The back surface 112 of the support layer is the mounting side of the construction element, i.e. the side of the construction element 100 which is facing the wall, floor, ceiling or object on which the construction element 100 is to be mounted. In the present embodiment, the material of the top layer 102 is porphyry and the top layer portion comprises cavities on the side of the top layer facing the support layer 110. The position and geometry of the cavities matches the positions and geometry of the light-emitters 108, here light-sources in the form of light-emitting diodes (LEDs) arranged on the carrier 106. However, other light-sources such as for example laser diodes and incandescent light-sources may equally well be used. Preferably, the cavities are made somewhat larger than the LEDs 108 in order to provide some extra space, both for facilitating easy assembly and also for reducing stress caused by differences in thermal expansion. The support layer 110 is advantageously made from the same material as the top layer and may also have cavities matching the positions of the LEDs 108 and the geometry of the carrier 106 and the LEDs 108 for allowing electrical connections to the LEDs. However, it is not required that the support layer 110 comprises cavities provided that the top layer 102 is so configured that light-sources, electrical connections and carrier can be arranged in the top layer 102. Furthermore, any space around the LEDs and between the carrier and the top layer caused by over dimensioning of the cavities in the top layer 102 may be filled with for example silicone or epoxy in order to protect the LEDs 108 and the carrier 106 from water.

Furthermore, the contact surface between the top layer 102 and the support layer 110 may preferably be approximately 40% of the total area or higher in order to provide sufficient mechanical stability for the construction element 100. The desired contact area may be achieved by providing the carrier 106 for example in the form of a net so that the top layer 102 and the support layer 110 may be in contact through the openings in the net. However, in cases where the contact surface is about 20% or higher, mechanical stability may be provided by filling the volume between the top layer 102 and the support layer 110 with for example a casting resin.

The thickness of the segment of the top layer 102 at the positions of the LEDs is sufficiently thin so that a transmittance of the top layer is at least 20%, thus allowing at least a portion of the light emitted by the LED in an on-state to be transmitted through the top layer 102 in order to radiate from the top surface 104. For materials such as porphyry, concrete and stone, the thickness may be in the range of 0.5-2 mm.

Moreover, the total thickness of the construction element 100 is determined both by the material of the top layer 102 and support layer 110 and by the size of the construction element. As an example, for a concrete construction element 100 the thickness is about 5 cm for sizes up to 30×30 cm and 6 cm for sizes up to 60×60 cm.

The carrier 106 may for example be formed through a thermal lamination process in which a network containing LEDs is placed between two layers of a preferably transparent polymer film such as a PET (polyethylene terephthalate) film, thereby forming a sandwich structure. LEDs used for this process are preferably of a low height (e.g. less than 1 mm) and not very fragile. The PET film may preferably have a thickness in the range of 100-200 μm. The sandwich structure is then introduced into a laminating machine, where the PET-film is heated to reach its glass transition temperature and a low pressure is added causing the two layers of film to melt together. The pressure may be added by a press covered with soft material which does not stick to the PET, e.g. silicone, or by letting the sandwich structure pass between two rolls, also covered with a soft material which does not stick to PET. The person skilled in the art readily realizes that there is a wide range of transparent materials which may be used in the aforementioned lamination process. Furthermore, the top layer 102 need not have a rough surface, a smooth surface such as that of a ceramic tile may for example be preferable in applications such as bathrooms and kitchens.

Figure 2:
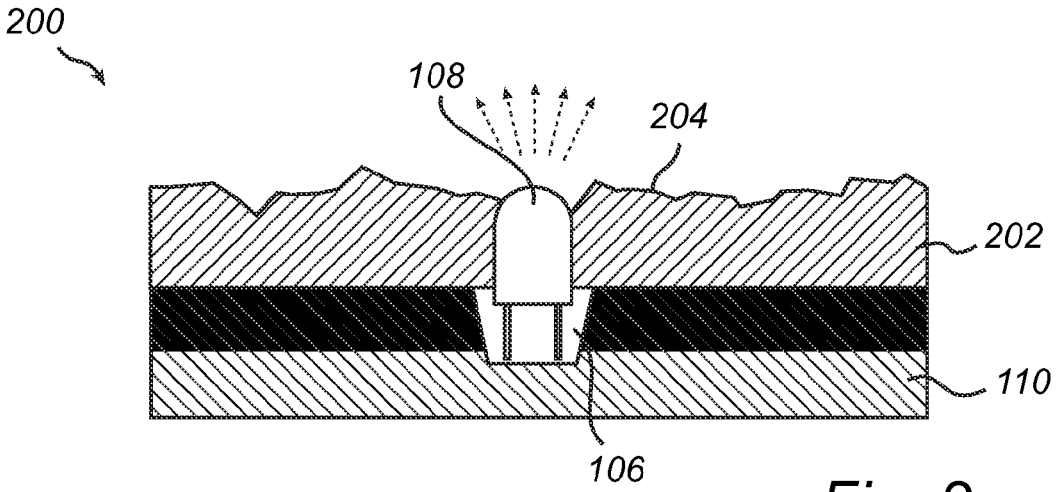
FIG. 2 schematically illustrates a construction element according to a second alternative embodiment of the invention.

FIG. 2 is a schematic illustration of a construction element 200 according to a second embodiment of the invention comprising a top layer 202 having a rough surface 204 having peaks and valleys, a carrier 106 comprising at least one light-source 108 and a support layer 110. Here, a hole is made through the top layer 204 so that a portion of the light-source 108 protrudes from the surface 204 of the top layer 202. In order to achieve a visual appearance of the surface 204 such that the light-source is non-recognizable when in an off-state, the LED 108 may preferably not protrude above the peaks of the rough surface 204. Furthermore, the color and texture of the portion of the LED 108 protruding from the surface 204 may be adapted to match the appearance of the surface 204.

Figure 3:
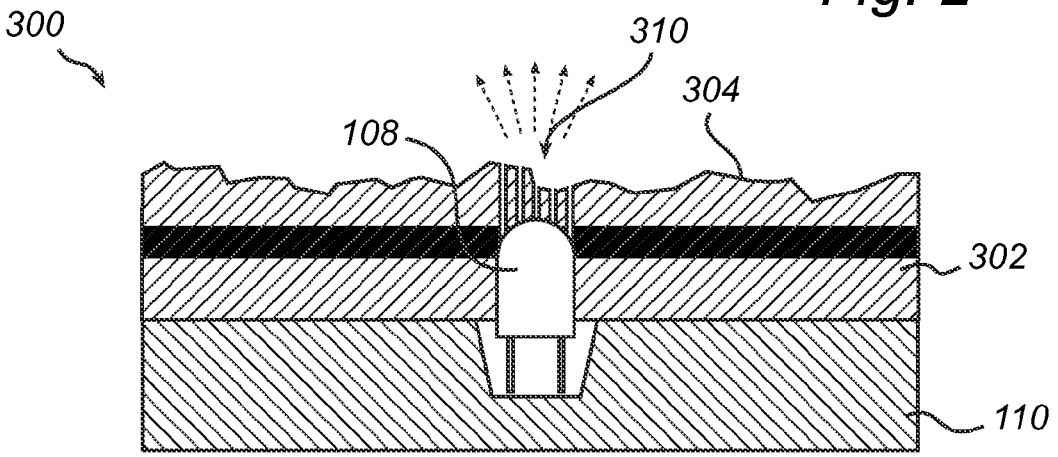
FIG. 3 schematically illustrates a construction element according to a third embodiment of the invention.

In FIG. 3, a third embodiment of the construction element similar to the embodiment illustrated by FIG. 1 is shown. However, in the construction element 300 the top layer 302 is not homogeneous in the portions covering the light-source 108, instead small openings in the form of holes 310 are formed in the portion of the top layer covering the light-source. Thereby, it is possible for the light emitted by the light-source 108 to escape from the surface 304 of the top layer 302 through the small holes 310 while the size of the holes 310 is sufficiently small so that they do not significantly alter the visual appearance of the surface 304. Typically, the size of the holes may be in the range of 0.5-2 mm. In further respects, the construction element 300 in FIG. 3 is similar to the construction elements described in relation to the aforementioned embodiments.

Figure 4:
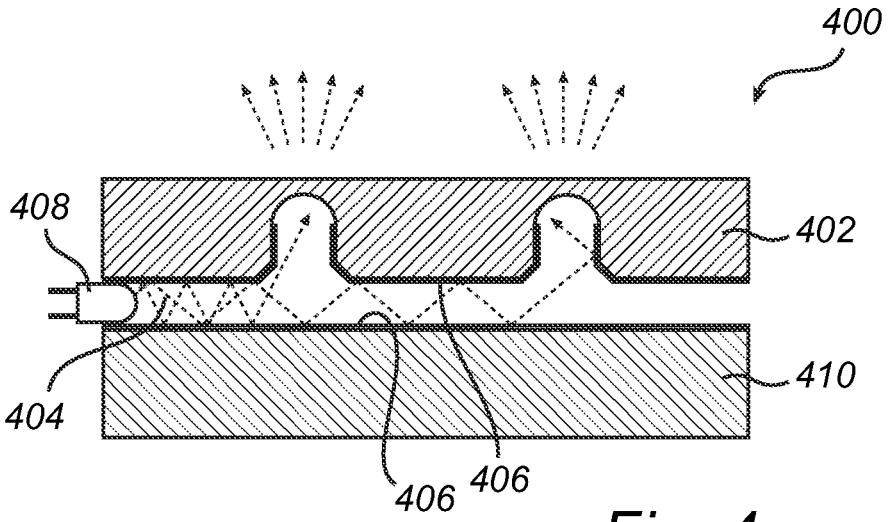
FIG. 4 schematically illustrates a construction element according to a fourth embodiment of the invention.

FIG. 4 illustrates a construction element 400 where a light-guide 404 is arranged between the top layer 402 and the support layer 410, and where the actual source of light 408 may be arranged outside of the construction element 404 such as on the side of the construction element as illustrated, or on a mounting side of the construction element. Furthermore, the light-guide 404 may preferable be partially coated 406 with a reflective material so that light only escapes from the light-guide 404 at the positions where the top layer 402 is sufficiently thin to allow light to be transmitted.

Figure 5:
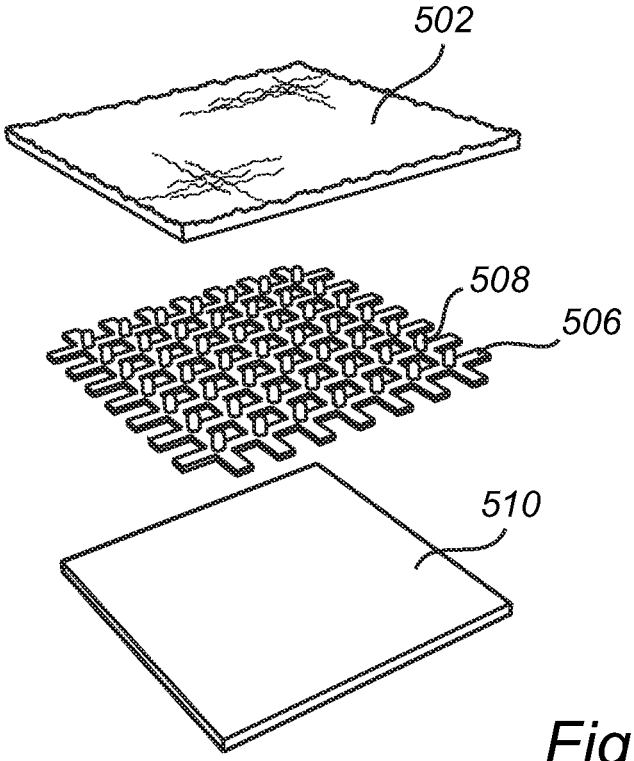
FIG. 5 schematically illustrates a method for manufacturing a construction element according to various embodiments of the invention.

FIG. 5 schematically illustrates a general method for fabricating a construction element 100. First, a carrier 506 in the form of a net comprising light-sources 508 is provided followed by a top layer 502 comprising cavities arranged and configured according to the light-sources 508 arranged on the carrier 506 such that the light-sources 508 are enclosed by the top layer 502 and the carrier 506. Next, the top layer 502 and carrier 506 is arranged on a support layer 510 for mechanical support, thereby forming a construction element 100. Furthermore, any remaining space between the top layer 502 and the support layer 510 may be filled by a material such as an epoxy resin or silicone, preferably by vacuum casting. Additionally, the carrier 506 comprising light-sources 508 may be provided in the form of individual strips or as a grid having an arbitrary configuration.

In the case of a top layer 502 made from concrete, the top layer 502 can be cast in the desired shape having the desired configuration of cavities using a similar process as when making concrete tiles. Likewise, a support layer 510 made from concrete may be made in a similar manner.

Furthermore, in the case of a top layer 502 made from a stone material such as porphyry, a tile of the material of choice is used as a starting point. Next, cavities in the mounting side of and/or holes through the top layer 502 can be made by for example milling or grinding. Small holes in the top layer 502 such as illustrated in FIG. 3 may advantageously be formed by water-jet cutting.

Even though the invention has been described with reference to specific exemplifying embodiments thereof, many different alterations, modifications and the like will become apparent for those skilled in the art. For example, a range of different construction element materials in various shapes may be used. Furthermore, the user facing surface may be smooth, rough, structured or patterned, or modified in other ways according to the desired application.

The invention claimed is:

1. A non-transparent light-emitting construction element comprising:

a construction element having a mounting side and a user-facing side to be facing a user when said light-emitting construction element is used in a construction; and a light-emitter embedded in said construction element, wherein said light-emitter is embedded in said construction element in such a way that said light-emitter is non-visible in its off-state and light from the light-emitter escapes from the construction element when the light-emitter is in its on-state, wherein said construction element comprises:

a top layer having a user facing side and a mounting side, wherein said mounting side comprises a plurality of cavities; and a carrier comprising a plurality of light-emitters, each being arranged in a respective one of said cavities in said top layer, wherein said top layer has a rough surface having peaks and valleys and wherein said cavities in said top layer are extending through said top layer and wherein the light-emitters are protruding from the surface of said top layer.

2. The light-emitting construction element according to claim 1, wherein said construction element material is selected form the group comprising stone, ceramics, concrete, porphyry and marble.

3. The light-emitting construction element according to claim 2, wherein said light-emitter is the light-output region of a light-guide.

4. A method for manufacturing a non-transparent light-emitting construction element comprising the steps of:

providing a carrier having at a plurality of light-emitters arranged thereon;

providing a layer of construction element material arranged on said carrier such that said at least one light-emitter is embedded in said construction element material in such a way that said light-emitter is non-visible in its off-state and light from the light-emitter escapes from the construction element when the light-emitter is in its on-state, wherein a layer of construction element material has a user facing side and a mounting side, wherein said mounting side comprises a plurality of cavities and wherein each of the plurality of light-emitters is arranged in a respective one of said cavities in said layer of construction element material, and wherein said layer of construction element material has a rough surface having peaks and valleys and wherein said cavities in said layer of construction element material are extending through said layer of construction element material and wherein light-emitters are protruding from the surface of said layer of construction element material.

5. The method for manufacturing a non-transparent light-emitting construction element according to claim 4, further comprising the step of arranging said carrier and layer of construction element material on a support layer.

6. The light emitting construction element according to claim 1, wherein the color and texture of the portion of the light-emitter protruding from the surface is adapted to match the appearance of the surface.

7. The light emitting construction element according to claim 1, wherein the peaks of the rough surface extend above the protruding light-emitter.

8. The light emitting construction element according to claim 1, wherein the cavities are larger than the light emitters.

9. The light emitting construction element according to claim 2, wherein space around the light emitters and between the carrier and the top layer is filled with silicone or epoxy.

10. The light emitting construction element according to claim 1, wherein the carrier is provided in the form of a net.

* * * * *